United States Patent [19]

Cain

[11] 4,421,166

[45] Dec. 20, 1983

[54] APPARATUS FOR INJECTING MATERIAL INTO A WELL-BORE

[76] Inventor: Robert W. Cain, 1812 Avondale, Colleyville, Tex. 76034

[21] Appl. No.: 264,575

[22] Filed: May 18, 1981

[51] Int. Cl.[3] ..... E21B 27/00

[52] U.S. Cl. ..... 166/162; 166/164; 222/82; 222/214; 428/422; 428/492

[58] Field of Search ..... 166/162, 164, 168–169; 222/82, 88, 214, 325, 340, 102; 428/422, 492; 526/255, 291

[56] References Cited

U.S. PATENT DOCUMENTS

| | | | |
|---|---|---|---|
| 2,673,844 | 3/1954 | Gilcrease | 428/492 |
| 3,366,278 | 1/1968 | Fobes | 222/82 |
| 3,576,691 | 4/1971 | Meyers | 428/492 |
| 4,220,264 | 9/1980 | Gamadia | 222/214 |
| 4,324,574 | 4/1982 | Fagan | 428/422 |

FOREIGN PATENT DOCUMENTS

| | | | |
|---|---|---|---|
| 446239 | 1/1948 | Canada | 222/102 |
| 625867 | 8/1961 | Canada | 166/162 |
| 830828 | 1/1952 | Fed. Rep. of Germany | 222/102 |

*Primary Examiner*—Ernest R. Purser
*Assistant Examiner*—Thuy M. Bui
*Attorney, Agent, or Firm*—Kanz & Timmons

[57] ABSTRACT

Injector apparatus is disclosed which includes a sealed self-contained replaceable vessel containing an ejectable material to be injected into the well-bore during well logging operations. The vessel comprises a flexible-wall, collapsible tubular-like cartridge which can be removed from the mounting apparatus in the string of logging tools and replaced with a new cartridge. Motive force apparatus pressurizes the material in the cartridge and a valve device, which is actuated by a solenoid device, controls the flow of material exiting from the cartridge. Passageways and an orifice in the mounting apparatus directs the flow of material from the valve device to the well-bore.

38 Claims, 8 Drawing Figures

APPARATUS FOR INJECTING MATERIAL INTO A WELL-BORE

BACKGROUND OF THE INVENTION

1. Field of the Invention

The present invention relates in general to apparatus for determining flow-related information in a well-bore and more particularly to apparatus for injecting radioactive material in the area of the well-bore which is under investigation.

2. Description of the Prior Art

With the present world oil situation, there is greater emphasis upon increasing domestic oil supplies which has resulted in increased activity in drilling new wells and also in bringing old wells back on-line which had previously been shut down. It is well known in the art of drilling new wells and/or re-opening old wells to perform well logging functions to determine desired information related to the well and the surrounding formations. The well loggers lower devices called logging tools into the well-bore on wireline. Such tools usually depend upon the force of gravity to permit positioning of the well tool at the desired location within the well-bore. There are many types of logs which are run, one of which is radioactivity logs. In the procedure to obtain the radioactivity logs, radioactive material is injected into the well-bore area which is under investigation and the radioactive material is then detected or traced with detection equipment which is located a known distance from the point of injection of the radioactive material. In order to obtain the most accurate results from the logs, the amount of radioactive material injected into the well bore area must be accurately known. These radioactivity logs are used to provide log injection profiles; determine zones of lost circulation and channel problems; locate cement tops in cementing casing; identify water and oil entry areas in producing wells; etc.

In the prior art injector tools, an electrical feed-thru is provided which allows the tool to be used anywhere in a string of production logging tools. A D-C motor is positioned within the tool and is operatively coupled to a ball-screw drive. The ball-screw drive is coupled through a piston rod to a piston, whose travel within a reservoir, whose walls are formed by the tool housing, causes the liquid radioactive material to be ejected therefrom through an orifice in the side of the reservoir. With a given size of piston bore, the length of travel of the piston determines the amount of radioactive material which is injected into the well-bore. Of course, the amount of travel of the piston is determined by the amount of rotation of the motor and the resulting travel of the ball-screw. The prior art injector tools are plagued by motor and ball-screw problems. Any attempt to operate the injector tool in an environment above about 145 degrees C. causes an increase in the motor problems, while severe derating of the motors then leads to space problems on all diameters. The loading and reloading of the tool, wherein a funnel is used to introduce the radioactive material into the reservoir, can be messy and lead to radioactive contamination of personnel and facilities. In the overall operation of the prior art injector tools, lack of consistent and accurate tracer shots is a problem.

The invention as claimed is intended to provide a remedy for inaccurate and inconsistent tracer shots. It also provides an injector apparatus with a temperature rating of up to 200 degrees C. with reliable and accurate operation. The possibility of spillage of the radioactive material by the operator is virtually eliminated. In addition, the invention allows the injector portion of the logging tool to be smaller in diameter and length.

SUMMARY OF THE INVENTION

The invention concerns an apparatus for injecting known amounts of radioactive material into a well-bore during well logging operations. The apparatus includes a self-contained sealed cartridge containing the radioactive material, mounting means for holding and positioning the cartridge within a predetermined space in the string of logging tools and valve means for controlling the flow of the radioactive material into the well-bore. Also included is a valve actuator means, preferably a solenoid, to control the amount of time the valve allows the radioactive material to flow. Motive force means, preferrably in the form of a spring, pressurizes the radioactive material within the cartridge and together with the tube means between the cartridge and the valve means, regulates the flow rate of the radioactive material from the cartridge. Means are provided for applying and/or releasing, without breaking down the production tool string, the motive force from the cartridge from a position external to the logging tool. The amount of radioactive material injected into the well-bore is controlled by the duration of the voltage pulse to the solenoid, which actuates the valve means, together with the size of the orifice from which the radioactive material is injected into the well bore. The cartridge is a bellows-type collapsible vessel formed from metal, rubber or plastic such that it can be thrown away or can be refilled and used again. The cartridge can be filled and/or refilled under laboratory conditions rather than under field conditions, thereby reducing any possibility for spillage.

Preferred means for carrying out the invention is described in detail below with reference to the drawing, which illustrates specific embodiments, in which:

DESCRIPTION OF THE PREFERRED EMBODIMENT

Figure 1:
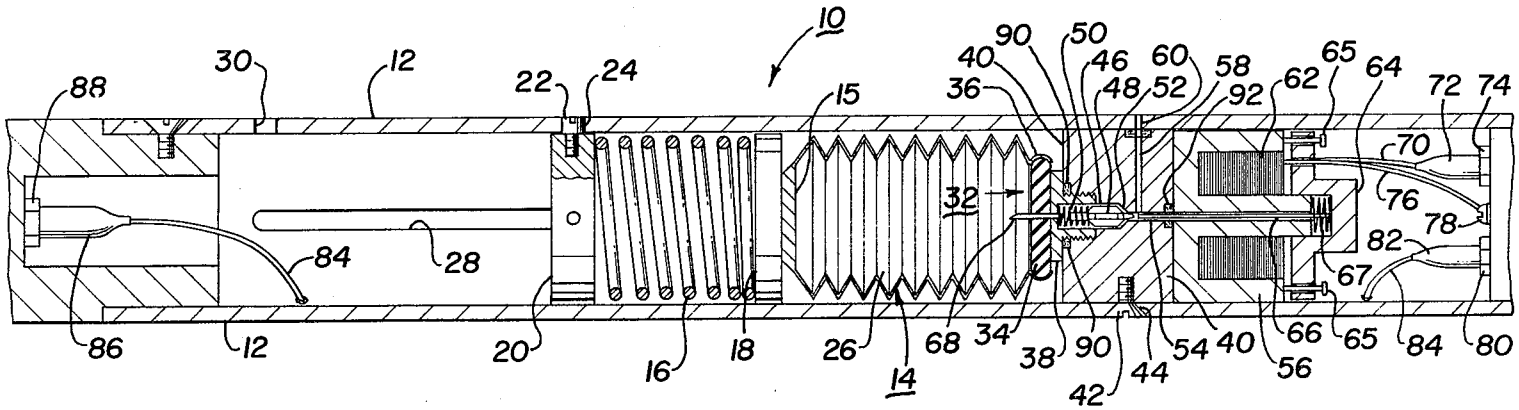
FIG. 1 is a simplified side plan view of an apparatus according to the present invention positioned within the injector tool housing with a portion of the tool housing deleted for clarity of the invention.

Referring now to the drawing wherein like reference numerals designate like or corresponding elements throughout the several views, and in particular to FIG. 1, an injector tool apparatus according to the present invention for injecting radioactive material in a well-bore is referred to generally by reference numeral 10. Injector tool 10 is shown comprising a housing 12, preferrably tubular in shape and configured on the ends thereof to be compatible with and operatively connect with other apparatus comprising the string of production logging tools. Operatively mounted within said housing 12 is a generally tubular bellows-type collapsible cartridge or capsule 14 having a helical compression spring 16 positioned in axial alignment therewith and applying a force against a first end 15 of cartridge 14, in an axial direction, through spacer 18 which is slideably positioned within housing 12 between first end 15 of cartridge 14 and spring 16. Located at the end of spring 16 opposite from spacer 18, stop 20 is locked at a predetermined position by set screw 22 positioned in aperture 24 (located in housing 12) and threaded into stop 20. Stop 20 is positioned to, in conjunction with the spring 16, provide the desired motive force against first end 15 of cartridge 14 which results in the desired pressure within cartridge 14 when it is filled with radioactive material 26, such as radioiodine ($I^{131}$). A typical operating pressure within cartridge 14 would be 150 psi. Slot 28, formed in housing 12, is for the express purpose of allowing an operator to apply or remove the force of spring 16 against spacer 18 and ultimately against cartridge 14 by means external to housing 12. Aperture 30, in conjunction with set screw 22, provides for locking stop 20 in a position such that cartridge 14 is unpressurized and cartridge 14 can be removed or replaced within housing 12.

Cartridge 14 is a generally tubular bellows-type collapsible container whose first end 15 has a pressurizing force applied to it through spacer 18. The second end 32 includes seal 34, preferably of rubber or a rubber-like material or such as a silicon rubber material such as chloroprene (chlorinated diene rubber), which is held in operative position by seal retainer 36. Seal 34 is similar in concept to that used on a serum bottle and is capable of self sealing after having been pierced. The second end 32 of cartridge 14 is positioned against valve retainer 38 with valve retainer 38 being removably fastened in valve housing 40 by conventional means such as mating threads, etc. Valve housing 40 is removably fastened in housing 12 by screw or bolt 42 in conjunction with aperture 44 in housing 12. Valve housing 40 and valve retainer 38 are configured such that when operatively joined, they form valve aperture 46 within which valve 48 and valve spring 50 are operatively positioned. Valve 48 is configured with ridges which provide stabilizing movement within the valve aperture 46 while the valleys between the ridges allow the radioactive material or tracer 26 to flow through the valve aperture 46. Valve 48 could also be configured with an external shape in the form of a triangle (when viewed from the end). The points of the triangle would provide the stabilization of valve 48 within valve aperture 46 while the sides of the valve would allow the radioactive material or tracer 26 to flow through the valve aperture 46. Valve spring 50 is a compression coil spring which forces valve 48 toward valve seat 52 which is formed at one end of valve aperture 46. Valve seat 52 is configured to form an exit opening 53 therein. Passageway 54 extends axially from valve seat 52 through valve housing 40 and solenoid frame 56. Passageway 58 connects passageway 54 with orifice 60 formed in the periphery of housing 12 or at the end of passageway 58. Solenoid frame 56 encloses solenoid coil 62 on three sides with the movable pole piece 64 positioned adjacent the remaining side of solenoid coil 62. Movable pole piece 64 is slidably mounted and retained, within operating limits, by pins 65. Solenoid frame 56 is removably fastened in housing 12 by bolt and aperture means (not shown) similar to that used with valve housing 40. Valve actuator 66 comprises a rod-like structure which is attached by conventional means to movable pole piece 64 and is positioned within passageway 54. One end of valve actuator 66 is positioned near valve seat 52. Compression spring 67 maintains movable pole piece 64 at a location away from solenoid frame 56 such that valve actuator 66 does not move valve 48 from valve seat 52 when solenoid coil 62 is not energized. Forming a part of valve retainer 38 is hollow projection or tube 68 similar to a hypodermic needle which is positioned to penetrate seal 34 of cartridge 14 and provide a passageway between the interior of cartridge 14 and valve aperture 46. Activating voltage is applied to solenoid coil 62 through lead 70, plug 72 and connector 74 with the ground return being through lead 76 and connected to the ground of housing 12 by screw 78. These connections are all communicated back to the surface of the well-bore through connector 80, plug 82 and lead 84 with lead 84 being fed through a feed-thru passageway in the wall of housing 12 to plug 86 and connector 88. From connector 88, continuity of the leads for the activating voltage is provided by the conventional cabling (not shown) of the string of production logging tools and wireline equipment.

In preparation of a logging run, stop 20 will be positioned in the unpressurized position and locked by set screw 22 in conjunction with aperture 30 such that cartridge 14, which was used on the last run, can be removed and replaced with a new cartridge 14 previously filled with the desired radioactive material or with a previously used cartridge 14 which has been previously refilled with the desired radioactive material and a new seal 34 installed, if required. Cartridge 14 can be manufactured (except for seal 34) from metal, rubber or plastic and therefore can be either considered reuseable or a throwaway unit. The preferable metal composition for cartridge 14 would comprise a 0.0001 inch lamination of copper between equal thicknesses of nickel, with the nickel containing a maximum of 0.02% of sulphur (because of the high temperature to which the cartridge 14 is subjected). The preferable rubber composition for cartridge 14 would include VITON and any other rubber materials which could stand the temperatures of the well-bore. VITON is a fluorelastomer based on the copolymer of vinylidene fluoride and hexafluoropropylene. The preferable plastic materials for cartridge 14 would include teflon and teflon derivatives. An appropriate cover (to be discussed below) in housing 12 allows access to cartridge 14 for the removal and insertion thereof in housing 12. After insertion of cartridge 14 within housing 12, stop 20 will be moved by rod means (not shown) inserted through slot 29 to the pressurized position and locked in that position by set screw 22 in conjunction with aperture 24. This step is performed without disassembly of the injector tool. The motive force from spring 16 moves spacer 18 and cartridge 14 toward valve retainer 38 until the second end 32 of cartridge 14 rests against valve retainer 38 and tube 68 has pierced seal 34. Upon piercing seal 34, radioactive material 26 is now capable of flowing into valve aperture 46 but cannot flow out of valve aperture 46 because valve 48 is seated against valve seat 52. Packing 90 prevents any well fluids from entering the valve aperture 46 through the surfaces between valve housing 40 and valve retainer 38.

The injector tool 10 is now ready to be assembled into the string of production logging tools with a top sub being operatively connected above housing 12 and a bottom sub being operatively connected below housing 12. All feed-thru connectors are operative such that solenoid coil 62 can be energized from the surface after the string of production logging tools, including housing 12, has been lowered to the desired location in the well-bore. When solenoid coil 62 is energized by the operator on the surface, movable pole piece 64 is drawn toward solenoid frame 56 resulting in valve actuator 66 pushing against valve 48 and overcoming the force of the pressurized radioactive material 26 such that valve 48 is moved from valve seat 52 allowing radioactive material 26 to escape cartridge 14 and be injected into the well-bore through passageways 54 and 58 and orifice 60. Packing 92 prevents the radioactive material 26 from discharging into solenoid frame 56. The cartridge 14 and valve 48 are pressure compensated with respect to the pressure in the well bore so the force from the actuation of the solenoid coil 62 need only to overcome the pressure of the radioactive material or tracer 26; this pressure being provided by spring 16. While the valve 48 is off the valve seat 52, the rate of flow of radioactive material 26 is controlled by the size of the opening in tube 68. Desirably, the opening in tube 68 is of a small size (0.005–0.010 inches) which causes a controllable pressure drop in cartridge 14. In this condition, any added pressure will not cause a significant increase in the rate of flow from cartridge 14. This limitation allows the time of solenoid coil 62 is energized to be the controlling parameter in determining the amount of radioactive material or tracer 26 injected into the well-bore. At the surface, a control unit (not shown) can pulse the solenoid coil 62 in intervals of time which are proportional to the amount of radioactive material 26 desired to be injected into the well bore. This control unit would accumulate the amount of time the solenoid coil was energized (representative of the amount of radioactive material 26 injected) and keep the operator advised as to the amount of radioactive material 26 remaining to be injected. As radioactive material 26 is injected, the force of spring 16 causes the first end 15 of cartridge 14 to move toward valve retainer 38.

Figure 2:
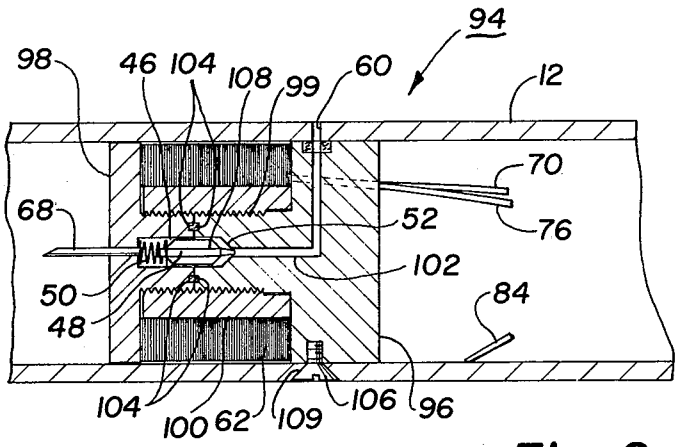
FIG. 2 is a simplified side plan view of an alternate embodiment of the solenoid and valve assemblies as shown in FIG. 1.

With reference to FIG. 2, an alternate embodiment of the solenoid and valve assemblies is disclosed in which the movable pole piece for the solenoid 94 comprises the valve 48 for controlling the flow of radioactive material from the cartridge 14. Solenoid 94 comprises a first frame 96 and a second frame 98 which are held in operative relationship by collar 100 by means (such as mating threads 99) and thereby forming valve aperture 46. Packing 104 seals the mating portions of frames 96, 98 which form valve aperture 46. Solenoid coil 62 is held in operative position by frame 96, 98. Valve 48 is held against valve seat 52 by valve spring 50. Passageway 102 connects the valve aperture 46 with orifice 60 in housing 12 to provide a discharge path for radioactive material 26 when valve 48 is displaced from valve seat 52. Tube 68 projects from valve aperture 46 and penetrates seal 34 of the second end 32 of cartridge 14 when cartridge 14 is installed in housing 12. Bolt 106 is installed through aperture 108 into mating threads in first frame 96 to hold solenoid 94 in operative position within housing 12. Leads 70 and 76 are connected to solenoid coil 62 for activation thereof. Solenoid coil 62 is wound in a manner that when coil 62 is activated, the resulting magnetic field moves valve 48 from valve seat 52 allowing the radioactive material to move through passageway 102 to orifice 60 and into the well-bore. Valve 48 is formed from material which provides the correct reaction with the magnetic field to cause valve 48 to move from valve seat 52. Valve 48 is configured with ridges 108 which provide stabilizing movement within the valve aperture 46 while the valleys between the ridges 108 allow the radioactive material or tracer 26 to flow through the valve aperture 46.

Figure 3:
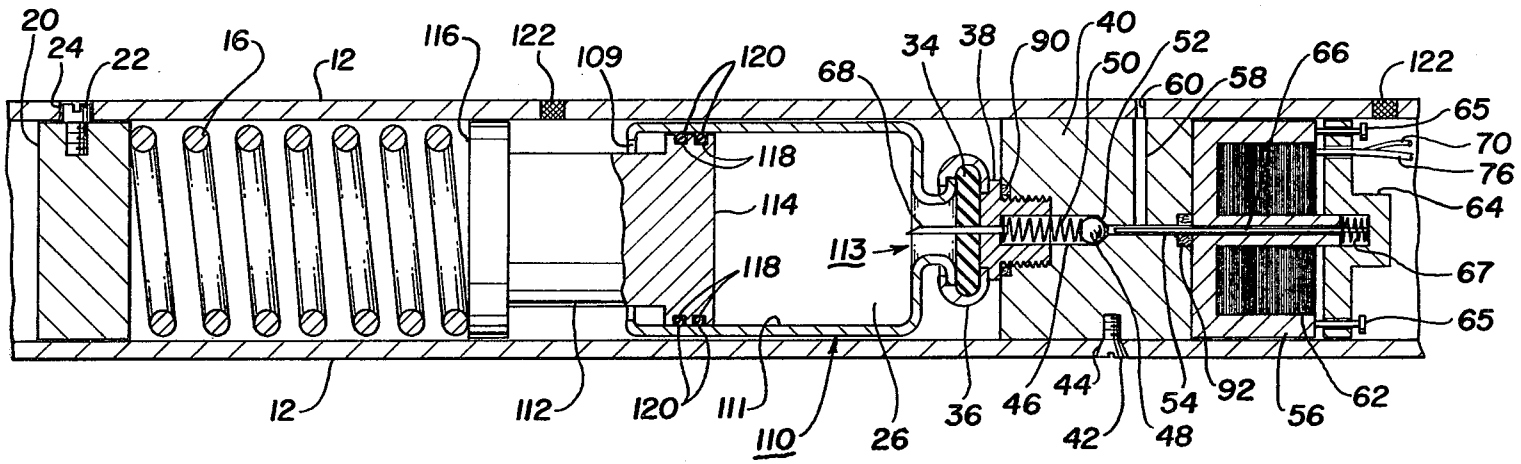
FIG. 3 is a view similar to that of FIG. 1 of another embodiment of the present invention.

With reference to FIG. 3, another embodiment of the injector apparatus is disclosed. Discussion will be limited to those elements which differ from those disclosed and discussed relative to FIG. 1 and thereby avoid repetition. Cartridge 110 comprises a solid-wall tubular vessel including an open-end 109 and a closed end 113 with the closed end 113 including a seal 34, preferrably of rubber or a rubber-like material, which is held in operative position by seal retainer 36. Cartridge 110 is made of rubber, plastic or metal and can be considered as being a throwaway unit or can be refillable. Through the open end of cartridge 110 is positioned a plunger 112 including a bottom portion 114 and a top portion 116. Circular grooves 118 are formed in the periphery of bottom portion 114 and contain gaskets 120 which form a seal between the smooth inner walls 111 of cartridge 110 and bottom portion 114 with the radioactive material or tracer 26 being captured within the volume formed by bottom portion 114, walls 111 and seal 34. The motive force to pressurize the radioactive material or tracer 26 is provided by spring 16, one end of which is positioned against stop 20. Stop 20 is located at a predetermined position which will result in the correct pressure occurring in cartridge 110 and is locked in position by set screw 22 positioned in aperture 24 formed in housing 12. Porous plugs 122 are installed in housing 12 to assure pressure compensation of the cartridge 110 and valve 48 with respect to the pressure in the well bore. It should be pointed out that valve 48 is configured as a ball valve in the embodiment of FIG. 3 while valve 48 in FIG. 1 is configured like a valve used in the float chamber of an automobile carburetor and may also include a rubber tip which contacts valve seat 52 to provide the sealing action. The operation of the embodiment of FIG. 3 is essentially the same as that of the embodiment of FIG. 1. As the radioactive material 26 is injected into the well bore, plunger 112 will be forced toward closed end 113 by the force of spring 16.

Figure 4:
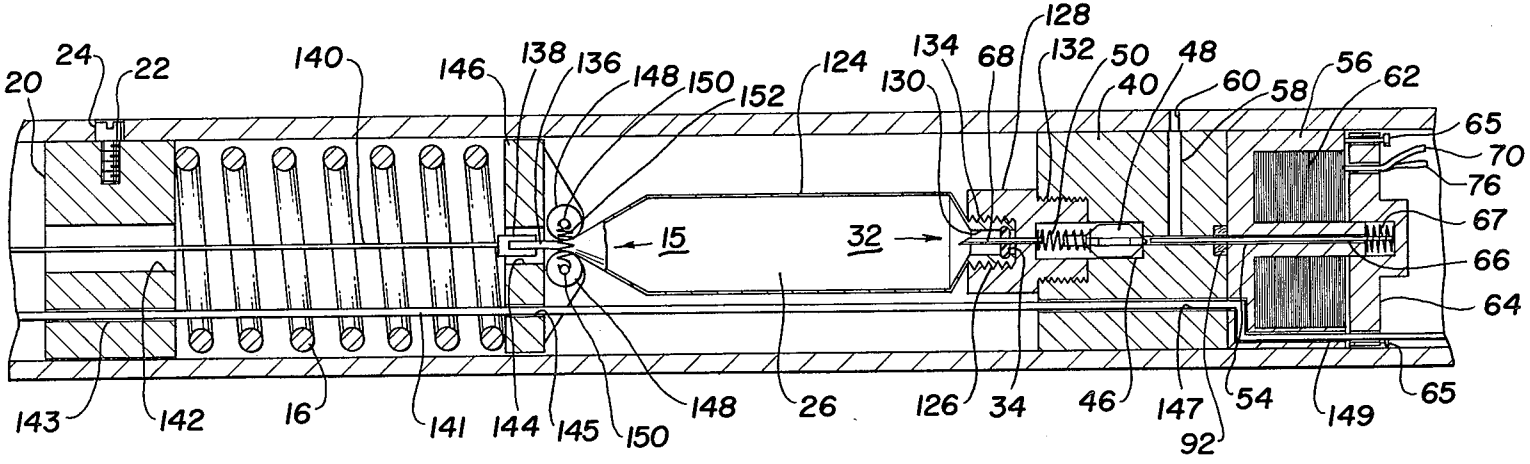
FIG. 4 is a similar view of another embodiment of the present invention.

With reference to FIG. 4, another embodiment of the injector apparatus is disclosed. Discussion will be limited to those elements which differ from those disclosed and discussed relative to FIGS. 1 and 3. Cartridge 124 comprises a flexible-wall tubular vessel configured similar to a hair creme or toothpaste tube. Cartridge 124 is made of rubber, plastic or metal and can be considered as being a throwaway unit or can be refillable. A second end 32 includes a threaded projection 126 with seal 34 providing a closure to an opening 130 defined by projection 126. Valve retainer 128 is removably mounted to valve housing 40 by mating threads 132. Cartridge 124 is removably mounted to valve retainer 128 by mating threads 134. The first end 15 of cartridge 124 is closed upon itself and sealed closed with a resulting tab 136 extending therefrom. Clamp 138 connects tab 136 to one end of cable 140 with the other end (not shown) being connected to one end of housing 12 in a conventional manner. Cable 140 passes through aperture 142 formed in stop 20. Clamp 138 and tab 136 are positioned near or within aperture 144 formed in block 146 which includes rollers 148 mounted for rotational movement by pins 150 which are mounted to block 146. Spring 152 (one spring on each end of rollers 148 although only one spring is shown) are mounted between pins 150 to force rollers 148 toward each other and apply pressure to cartridge 124 whose first end 15 is positioned therebetween. Spring 16, positioned between stop 20 and block 146 provides a motive force to move block 146 toward the second end of cartridge 124 resulting in pressurization of the radioactive material or tracer 26 within cartridge 124 as rollers 148 squeeze cartridge 124 and cable 140 retains first end 15 at a predetermined location. During the operation of injecting the radioactive material 26 into the well-bore, block 146 will move toward the threaded projection 126 of cartridge 124 as the radioactive material is expelled therefrom. Rollers 148 will squeeze the flexible walls of cartridge 124 together while spring 16 will force the rollers 148 and block 146 toward the threaded projection 126; thereby maintaining the necessary and desired pressure within cartridge 124. Electrical feed through 141 passes through aperture 143 in stop 20, through aperture 145 in block 146, through aperture 147 formed in valve housing 40 and through aperture 149 formed in solenoid frame 56.

Figure 5:
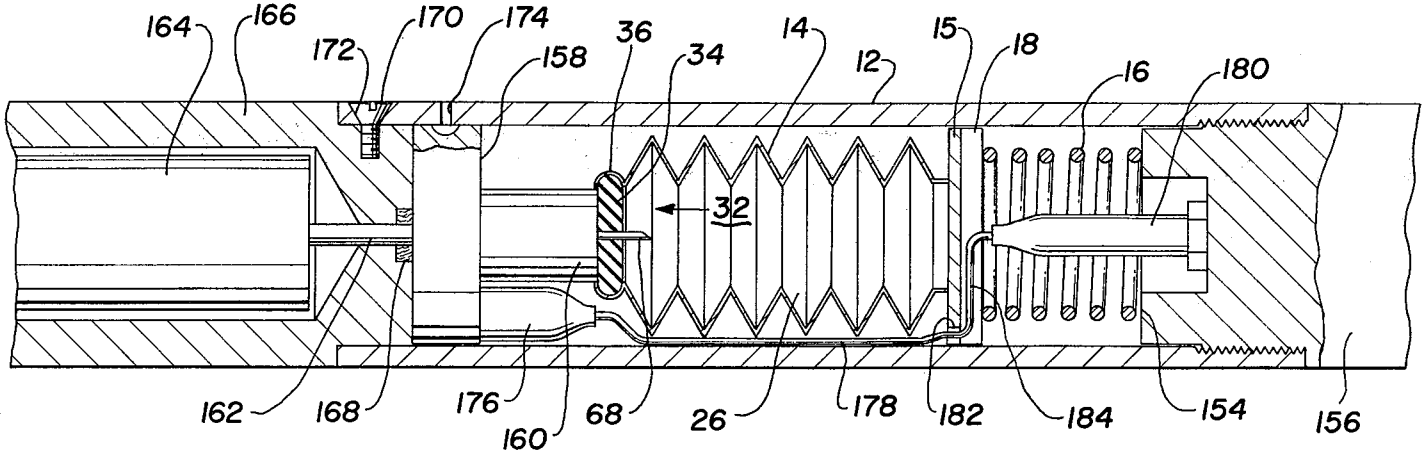
FIG. 5 is a similar view of another embodiment of the present invention.

With reference to FIG. 5, another embodiment of the injector apparatus is disclosed. Operatively mounted within housing 12 is a bellows-type collapsible cartridge or capsule 14 having a helical compression spring 16 positioned in axial alignment therewith and applying a force against a first end 15 of the cartridge 14 is an axial direction through spacer 18 which is slideably positioned within housing 12 between first end 15 and spring 16. Located at the end of spring 16 opposite from spacer 18, is the end 154 of bottom sub 156 of the string of production tools. Spring 16 provides the desired motive force against cartridge 14 which results in the desired pressure within cartridge 14 when it is filled with radioactive material or tracer 26 and maintains suction for gear pump 158. Cartridge 14 can be manufactured from metal, rubber or plastic and can be considered a throw-away unit or can be re-used. Second end 32 of cartridge 14 includes seal 34, made of rubber or a rubber-like material, which is held in place by seal retainer 36. Second end 32 is positioned against housing 160 which includes tube 68 which penetrates seal 34. Housing 160 is operatively attached to gear pump 158 and is positioned between gear pump 158 and second end 32 and provides a passageway from tube 68 to gear pump 158 for radioactive material 26. Attached to gear pump 158 by shaft 162 is D-C motor 164 which is held in position by mount 166 which also holds gear pump 158. Packing 168 prevents radioactive material 126 from exiting gear pump 158 along shaft 162. Mount 166 is removably fastened to housing 12 by screw or bolt 170 in conjunction with aperture 172. Back pressure valve and nozzle 174 allows radioactive material 26 to be ejected into the well bore through gear pump 158 without allowing well fluids back into the gear pump 158.

Electrical continuity through the injector tool section of the production tool string is provided by connector 176, lead 178 and connector 180. Lead 178 passes through aperture 182 in first end 15 and passageway 184 in spacer 18.

In operation, D-C motor 164 is activated from the well surface for predetermined periods to inject the radioactive material 26 in cartridge 14 through tube 68, housing 160, gear pump 158 and backpressure valve and nozzle 174. The amount of radioactive material 26 injected into the well-bore is controlled by the on-time of D-C motor 164 as it drives gear pump 158.

Figure 6:
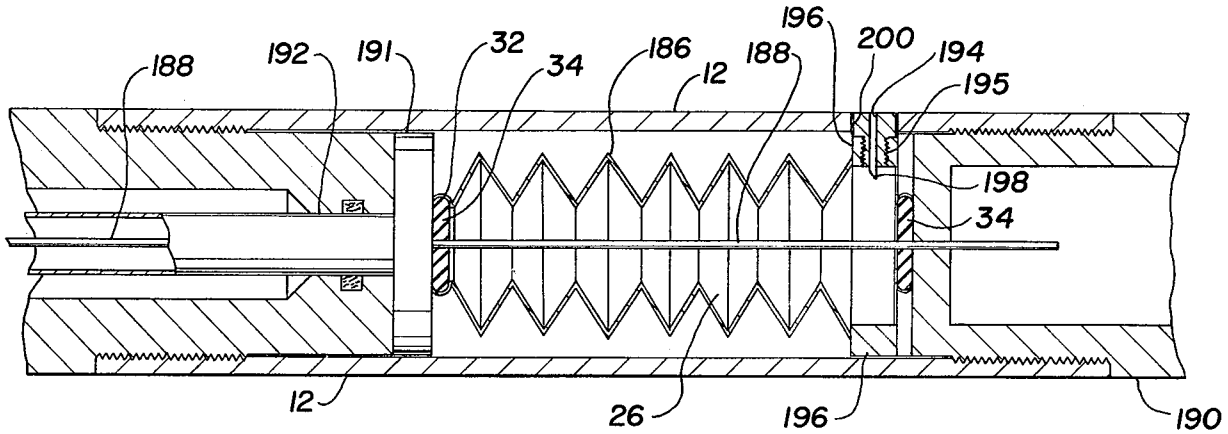
FIG. 6 is a similar view of another embodiment of the present invention provided as a retrofit to units presently in the market.

With reference to FIG. 6, another embodiment of the injector apparatus is disclosed with this embodiment being capable of being used in injection units presently on the market which at the present time do not incorporate the concept of a throw-away capsule or cartridge 14 which holds the radioactive material 26. Cartridge 186 is a generally tubular bellows-type collapsible container whose first end 15 and second end 32 both include seals 34, made of rubber or a rubber-like material. Cartridge 186 can be manufactured from metals, rubber or plastic and can be either considered as a throw-away unit or refilled and reused. Insulated electrical feed-thru 188 passes through seals 34. First end 15 of cartridge 186 rests against the top end 190 of the bottom sub in the string of tools. Spacer 191 rests against second end 32 of cartridge 186 with the motive force to pressurize the radioactive material 26 within cartridge 186 being supplied by a motor and ball screw drive (not shown) through shaft 192 and spacer 18 by forcing second end 32 toward first end 15. The unit could be retrofitted such that a spring (not shown) could provide the motive force for pressurization. With the motor drive unit providing the motive force, the amount of on time of the motor would control the amount of radioactive material 26 to be injected into the well-bore.

Nozzle and cracking pressure valve 194 is connected by mating threads 195 into mounting means 196 and contains tube 198. When nozzle and cracking pressure valve 194 is mounted into mounting means 196 through aperture 200, tube 198 pierces the wall of cartridge 186 such that the radioactive material 26 is then capable of being injected into the well-bore upon the application of motive power to cartridge 186.

Figure 7A:
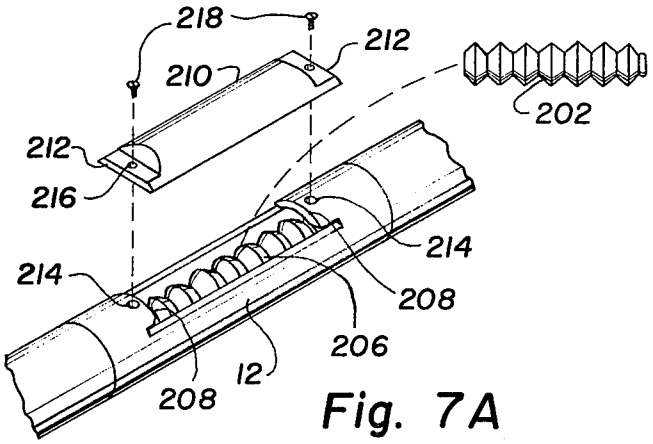
FIG. 7A is a simplified perspective view of a section of injector tool housing with the cover removed.
Figure 7:
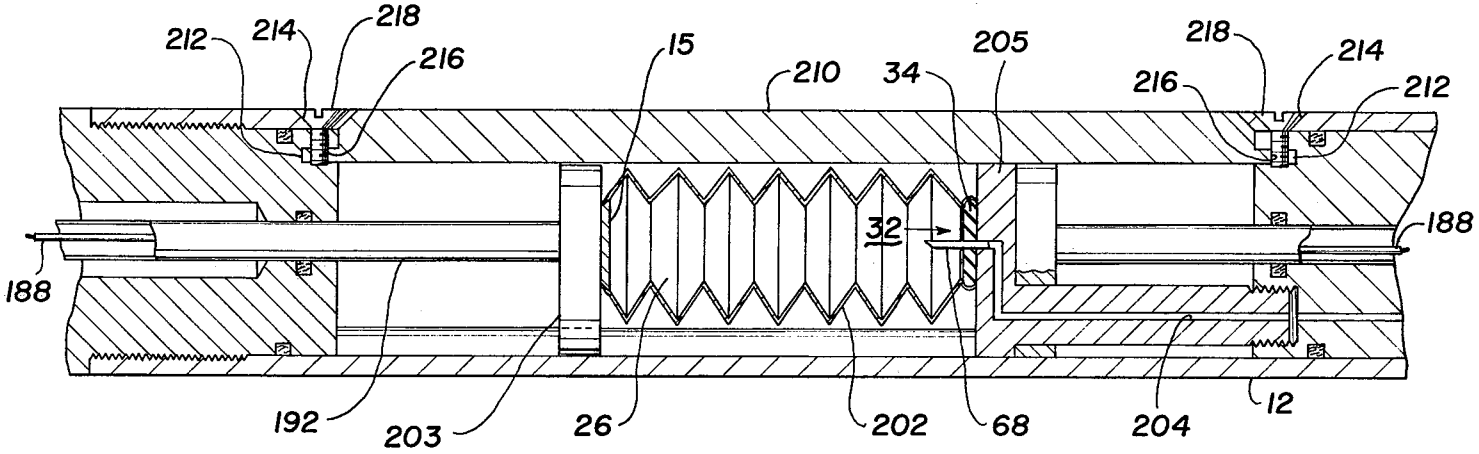
FIG. 7 is a similar view of another embodiment of the present invention provides as a retrofit to units presently in the market.

With reference to FIG. 7, another embodiment of the injector apparatus is disclosed with this embodiment also being capable of being used in injector units presently on the market. Cartridge 202 is also a generally tubular bellows-type collapsible container whose first end 15 rests against piston 203. The motive force to pressurize the radioactive material 26 in cartridge 202 is supplied by a motor and ball screw drive (not shown) through shaft 192 and piston 203. The unit could be retrofitted such that a spring (not shown) could provide the motive force for pressurization. Second end 32 of cartridge 202 includes seal 34 which is pierced by tube 68 when cartridge 202 is operatively positioned within housing 12. Tube 68 is connected to passageway 204 which leads to the nozzle and/or backpressure valve (not shown) through which the radioactive material is injected into the well-bore. Passageway 204 is formed in mount 205 which is held in position within housing 12 by conventional means, such as bolt and aperture means. Mount 205 also positions and holds both cartridge 202 and tube 68.

With further reference to FIG. 7 and also to FIG. 7A, means for providing access to the area holding the throw-away cartridge 14 are shown. A generally rectangular cutout 206 is shown in housing 12 with extensions 208 protruding over a portion of cutout 206. Cover 210 is configured to fit cutout 206 and has two tabs 212 which are positioned beneath extensions 208. Apertures 214 in extensions 208 are in alignment with threaded apertures 216 in cover 210. Bolts 218 pass through apertures 214 and are threaded into threaded apertures 216 to retain cover 210 in operative position. By providing this type of access to cartridge 14, cartridges 14 can be very easily removed and replaced without disassembly of the string of logging tools.

Although the present invention has been described with reference to certain preferred embodiments, it will be appreciated by those skilled in the art that various modifications, alternatives, variations, etc. may be made without departing from the spirit and scope of the invention as defined in the appended claims.

What is claimed is:

1. An injector apparatus comprising:

a sealed self contained, replaceable vessel containing a predetermined amount of ejectable material;

a motive force means operatively positioned with respect to said vessel and to pressurize the material within said vessel;

a first exit means operatively positioned with respect to said vessel and capable of providing a passageway from said vessel through which said ejectable material is capable of flowing and being ejected therefrom;

a valve means operatively positioned with respect to said vessel and capable of controlling the flow of material from said vessel through said first exit means; and actuator means operatively positioned to control the operation of said valve means, said actuator means comprising a solenoid means operatively positioned with respect to said valve means whereby a valve in said valve means is caused to be positioned away from a valve seat such that the ejectable material can flow through an exit opening formed in said valve seat when said solenoid is actuated.

2. The apparatus of claim 1, further including a second exit means operatively positioned with respect to said valve means and capable of providing a passageway through which said ejectable material is ejected from said injector apparatus through said valve means.

3. The apparatus of claim 2, wherein said second exit means includes an exit orfice and a tubular structure connected between said exit orfice and said valve means.

4. The apparatus of claim 1, wherein said vessel comprises a generally tubular shaped cartridge.

5. The apparatus of claim 4, wherein said cartridge includes flexible-wall construction.

6. The apparatus of claim 5, wherein said flexible-wall construction comprises bellows-type construction.

7. The apparatus of claim 4, wherein said cartridge is fabricated from a rubber material.

8. The apparatus of claim 4, wherein said cartridge is fabricated from a plastic material including teflon.

9. The apparatus of claim 4, wherein said cartridge is fabricated from a metal material including a 0.0001 inch lamination of copper between equal thicknesses of nickel containing a maximum of 0.02% sulphur.

10. The apparatus of claim 4, wherein said cartridge includes a first pierceable seal formed in a first end thereof wherein said first pierceable seal is of the type provided in a serum bottle.

11. The apparatus of claim 10, wherein said seal comprises a rubber material which is capable of self-sealing after having been pierced.

12. The apparatus of claim 10, wherein said cartridge further includes a second pierceable seal formed in a second end thereof wherein said second pierceable seal is of the type provided in a serum bottle.

13. The apparatus of claim 12, wherein said cartridge includes flexible-wall construction.

14. The apparatus of claim 1, wherein said motive force comprises a spring.

15. The apparatus of claim 14, wherein said spring comprises a coiled compression type spring.

16. The apparatus of claim 14, wherein said motive force further includes roller means with rollers being positioned on opposite sides of said vessel, said roller means including spring means positioned to force said rollers towards each other.

17. The apparatus of claim 16, further including cable means attached to a second end of said vessel for maintaining said second end of said vessel in a predetermined location during movement of said roller means.

18. The apparatus of claim 1, wherein said valve means includes a valve aperture, a valve seat positioned at one end of said valve aperture and forming an exit opening therein, a valve and a spring means to force said valve toward a seating position against said valve seat.

19. The apparatus of claim 1, wherein said first exit means comprises a hollow, tubular structure which pierces said vessel and provides a passageway between the interior of said vessel and said valve means and regulates the amount of ejectable material ejected from said vessel.

20. The apparatus of claim 1, further including an actuator rod, said actuator rod being operatively positioned with respect to said solenoid means and said valve means whereby said valve in said valve means is caused to be positioned away from said valve seat by said actuator rod such that the ejectable material can flow through an exit opening formed in said valve seat when said solenoid is actuated.

21. An injector apparatus for use as part of a string of logging tools in a well-bore, said device comprising:

housing means positioned at a predetermined location in the spring of logging tools;

a sealed self-contained replaceable vessel positioned at a predetermined location within said housing means and containing a predetermined amount of material which is capable of being discharged from said vessel;

motive force means operatively positioned with respect to said vessel such that said motive force means is capable of pressurizing said material within said vessel;

a first exit means operatively positioned with respect to said vessel and capable of providing a passageway from said vessel through which said ejectable material is capable of flowing and being ejected therefrom;

a valve means operatively positioned with respect to said vessel and capable of controlling the flow of mateial from said vessel through said first exit means; and actuator means operatively positioned to control the operation of said valve means, said actuator means comprising a solenoid means operatively positioned with respect to said valve means whereby a valve in said valve means is caused to be positioned away from a valve seat such that the ejectable material can flow through an exit opening formed in said valve seat when said solenoid is actuated.

22. The apparatus of claim 21, wherein said flexible-wall construction comprises bellows-type construction.

23. The appartus of claim 21, wherein said valve means includes a valve aperture, a valve seat positioned at one end of valve aperture and forming an exit opening therein, a valve and a spring means to force said valve toward a seating position against said valve seat.

24. The apparatus of claim 21, wherein said first exit means comprise a hollow, tubular structure which pierces said vessel and provides a passageway between the interior of said vessel and said valve means.

25. The apparatus of claim 21, further including an actuator rod, said actuator rod being operatively positioned with respect to said solenoid means and said valve means whereby said valve in said valve means is caused to be positioned away from said valve seat by said actuator rod such that the ejectable material can flow through an exit opening formed in said valve seat when said solenoid is actuated.

26. The apparatus of claim 21, further including a second exit means operatively positioned with respect to said valve means and capable of providing a passageway through which said dischargeable material is discharged from said housing means through said valve means and into said well-bore.

27. The apparatus of claim 26, wherein said second exit means includes an exit orfice and a tubular structure connected between said exit orfice and said valve means.

28. The apparatus of claim 26, wherein said motive force comprises a spring.

29. The apparatus of claim 28, wherein said spring comprises a coiled compression type spring.

30. The apparatus of claim 28, wherein said motive force further includes roller means with rollers being positioned on opposite sides of said vessel, said roller means including spring means positioned to force said rollers towards each other.

31. The apparatus of claim 30, further including cable means attached to a second end of said vessel for maintaining said second end of said vessel in a predetermined location during movement of said roller means.

32. The apparatus of claim 21, wherein said vessel comprises a generally tubular shaped cartridge.

33. The apparatus of claim 32, wherein said cartridge includes a first pierceable seal formed in a first end thereof wherein said first pierceable seal is of the type provided in a serum bottle.

34. The apparatus of claim 33, wherein said seal comprises a rubber material which is capable of self-sealing after having been pierced.

35. The apparatus of claim 33, wherein said cartridge further includes a second pierceable seal formed in a second end thereof wherein said second pierceable seal is of the type provided in a serum bottle.

36. The apparatus of claim 32, wherein said cartridge is fabricated from a rubber material.

37. The apparatus of claim 32, wherein said cartridge is fabricated from a plastic material including teflon.

38. The apparatus of claim 32, wherein said cartridge is fabricated from a metal material including a 0.0001 inch lamination of copper between equal thicknesses of nickel containing a maximum of 0.02% sulphur.

* * * * *